United States Patent [19]

Gestaut

[11] 4,350,608

[45] Sep. 21, 1982

[54] OXYGEN CATHODE FOR ALKALI-HALIDE ELECTROLYSIS AND METHOD OF MAKING SAME

[75] Inventor: Lawrence J. Gestaut, Painesville, Ohio

[73] Assignee: Diamond Shamrock Corporation, Dallas, Tex.

[21] Appl. No.: 236,027

[22] Filed: Feb. 19, 1981

Related U.S. Application Data

[62] Division of Ser. No. 899,548, Apr. 24, 1978, Pat. No. 4,278,525.

[51] Int. Cl.[3] ..... C25B 11/06; H01M 4/04; B27J 5/00

[52] U.S. Cl. ..... 252/425.3; 264/105; 264/127; 427/115; 427/125

[58] Field of Search ..... 429/42; 204/263–266, 204/284, 290 R, 294; 252/425.3; 427/115, 125; 264/105, 127

[56] References Cited

U.S. PATENT DOCUMENTS

| | | | |
|---|---|---|---|
| 3,062,909 | 11/1962 | Reutschi | 429/44 |
| 3,252,839 | 5/1966 | Langer et al. | 252/425.3 |
| 3,316,124 | 4/1967 | Kronenberg | 427/115 |
| 3,329,530 | 7/1967 | Kometani et al. | 429/42 |
| 3,400,019 | 9/1968 | Le Duc | 429/42 |
| 3,415,689 | 12/1968 | Carson, Jr. et al. | 429/40 |
| 3,423,247 | 1/1969 | Darland et al. | 429/42 X |
| 3,438,815 | 4/1969 | Giner | 429/42 |
| 3,457,113 | 7/1969 | Deibert | 429/42 X |
| 3,553,022 | 1/1971 | Gregory | 429/42 |
| 3,600,230 | 8/1971 | Stachurski et al. | 429/42 X |
| 3,676,222 | 7/1972 | Deibert | 429/42 |
| 3,854,994 | 12/1974 | Binder et al. | 429/40 X |
| 3,856,640 | 12/1974 | Halfar et al. | 204/294 |
| 3,899,356 | 8/1975 | Groult et al. | 429/42 |
| 3,923,628 | 12/1975 | Gritzner | 204/237 |
| 3,935,029 | 1/1976 | Baker et al. | 429/42 |
| 4,035,255 | 7/1977 | Gritzner | 204/265 |
| 4,278,525 | 7/1981 | Gestaut | 204/266 |

*Primary Examiner*—P. E. Konopka
*Attorney, Agent, or Firm*—Woodrow W. Ban

[57] ABSTRACT

An air/oxygen electrode substrate for use as a cathode in alkali metal halide electrolysis processes is formed by compressing a prefused mixture of carbon black and a hydrophobic polymer such as polytetrafluoroethylene under high pressures and at a temperature in excess of the sintering temperature of the polymer and below its decomposition temperature. Optionally, the electrode may be formed having a core comprised of a metal mesh which acts to better distribute the applied voltage and to reinforce the electrode. Further, a sheet of hydrophobic backing material such as TEFLON fabric may be incorporated into the compressed mixture to increase the hydrophobic properties of the cathode. Electrocatalysts may then be deposited on the surface of the electrode substrate to produce an oxygen electrode having significant voltage advantage over mild steel cathodes in alkali-halide electrolysis cells.

4 Claims, No Drawings

OXYGEN CATHODE FOR ALKALI-HALIDE ELECTROLYSIS AND METHOD OF MAKING SAME

This is a division, of application Ser. No. 899,548, filed Apr. 24, 1978 now U.S. Pat. No. 4,278,525.

This invention relates to the art of electrodes for alkali metal halide electrolysis and, more particularly, to an oxygen depolarized cathode formed from a mixture of a hydrophobic polymer and an electroconductive material to be used for the production of alkali metal hydroxide and halogen in such a manner as to significantly reduce the voltage necessary for the operation of such electrolytic cells and to increase substantially the power efficiency available from such cells utilizing the electrodes of this invention.

BACKGROUND OF THE INVENTION

Chlorine and caustic are essential, large volume commodities which are basic chemicals required by all industrial societies. They are produced almost entirely electrolytically from aqueous solutions of alkali metal halides or, more particularly, sodium chloride, with a major portion of such production coming from diaphragm-type electrolytic cells. In the diaphragm electrolytic cell process, brine (saturated sodium chloride solution) is fed continuously to the anode compartment to flow through a diaphragm usually made of asbestos particles formed over a cathode structure of a foraminous nature. To minimize back migration of the hydroxide ions, the flow rate is always maintained in excess of the conversion rate so that the resulting catholyte solution has unused or unreacted sodium chloride present. Hydrogen ions are discharged from the solution at the cathode in the form of hydrogen gas. The catholyte solution containing caustic soda (sodium hydroxide), unreacted sodium chloride and other impurities, must then be concentrated and purified to obtain a marketable sodium hydroxide commodity. The unreacted sodium chloride is returned to the electrolytic cells for reuse in further production of sodium hydroxide and chlorine. The evolution of hydrogen gas requires a high voltage thereby reducing the power efficiency possible from such an electrolytic cell thus creating an energy inefficient means of producing sodium hydroxide and chlorine gas.

With the advent of technological advances such as dimensionally stable anodes and various coating compositions therefor which permit ever narrowing gaps between electrodes, the electrolytic cell has become more efficient in that the power efficiency is greatly enhanced since electrolyte resistance in the narrow anode/cathode gap is reduced. Also, the hydraulically impermeable membrane has added a great deal to the use of electrolytic cells in terms of selective migration of various ions across the membrane so as to exclude contaminants from the resultant product thereby eliminating at least some of the costly purification and concentration steps required in the processing of diaphragm cell products.

The largest advancements in electrolytic cell technology have tended to improve the efficiency of the anodic side and the membrane or seperator portion of electrolytic cells. Currently, more attention is being directed to the cathodic side of the electrolytic cell in an effort to improve the power efficiency of the cathodes to be utilized in the process and to create a significant energy savings in the cathode reaction process.

In a conventional chlorine and caustic cell, employing a conventional anode and cathode and a diaphragm seperator therebetween, the electrolytic reaction at the cathode may be represented as $$2H_2O+2e^- \text{ yields } H_2+2OH \quad (1)$$

The discharge potential of this reaction as measured against a standard hydrogen electrode is −0.83 volts. The desired reaction under ideal circumstances to be promoted at the cathode would be $$2H_2O+O_2+4e^- \text{ yields } 4OH^- \quad (2)$$

The potential for this reaction is +0.40 volts. The use of this reaction as opposed to the common hydrogen discharge reaction would result in a theoretical voltage savings of 1.23 volts. The electrical energy necessarily consumed to produce the hydrogen gas which is an undesirable reaction product of the cathode in conventional electrolytic cells has not been counterbalanced efficiently in the industry by the utilization of the resultant hydrogen. While some uses have been made of the excess hydrogen gas, those uses have not made up the difference in expenditure of electrical energy necessary to evolve the hydrogen. Thus, if the evolution of hydrogen gas could be substantially reduced or eliminated from the electrolysis process, it would save electrical energy and make production of chlorine and caustic more energy efficient, while avoiding the separation and disposal problems associated with the production of hydrogen.

The oxygen electrode presents one possibility for the elimination of the production of hydrogen since it consumes oxygen to combine with water and the electrons available at the cathode in accordance with the following equation $$2H_2O+O_2+4e^- \text{ yields } 4OH^- \quad (3)$$

It is readily apparent that this reaction is more energy efficient by the very absense of the production of any hydrogen at the cathode and at least theoretically affords the reduction in potential as shown above. Oxygen electrodes are normally porous materials and the reaction is accomplished by feeding an oxygen-rich fluid such as air or pure oxygen to one side of the oxygen electrode where the oxygen has ready access to the electrolytic surface in contact with the electrolyte so as to be consumed in accordance with the above equation. This does, however, require a significantly different structure for the electrolytic cell itself so as to provide for an oxygen compartment on one side of the cathode so that the oxygen-rich fluid may be fed thereto.

Oxygen electrodes have become well-known in the art since many NASA projects to promote space travel during the 1960's also provided funds for the development of a fuel cell utilizing an oxygen cathode and a hydrogen anode to produce electrical current for utilization in a spacecraft by feeding hydrogen and oxygen gas to the electrodes to make water. While this major, government-financed research effort produced many fuel cell components including an oxygen electrode, the circumstances and the environment in which the fuel cell oxygen electrode functions are quite different from that which is experienced in a chlor-alkali cell. Thus, while much of the technology gained during the NASA projects is of value in the chlor-alkali industry with regard to the development of a oxygen electrode, much further development has been necessary to adapt the oxygen electrode to the chlor-alkali cell cathode environment.

Some attention has been given to the use of an oxygen cathode in a chlor-alkali cell so as to increase the efficiency in the manner described to be theoretically feasible, but thus far, the oxygen cathode has failed to receive significant interest so as to produce a commercially effective or economically viable electrode for use in an electrolytic cell to produce chlorine and caustic. While it is recognized that a proper oxygen cathode will be necessary to realize the theoretical efficiencies to be derived therefrom, the chlor-alkali cell will require an electrode significantly different from that of a fuel cell since the electrical potential will be applied to the chlor-alkali cell for the production of chlorine and caustic rather than electrical potential being drawn from the electrodes as in a fuel cell. Therefore, it would be advantageous to develop an oxygen cathode which will approach the theoretical electrical efficiencies possible with an ideal oxygen electrode in the cathode compartment of a chlor-alkali electrolytic cell.

In order to operate efficiently and maintain a reasonable lifetime in a cell environment, the electrolyte should penetrate into the electrode sufficiently to reach the interior surfaces of the electrode and thereby contact the gas in as many places as possible in the presence of the electrode and any catalyst associated therewith. However, the electrode must be sufficiently hydrophobic to prevent the electrolyte from flooding the pores of the electrode and "drowning" the electrode. When drowning occurs, the reaction zone is moved away from the electrolyte side of the electrode deeper into the interior of the electrode. This results in some electrolyte being relatively immobile within the pores of the electrode and somewhat separated from the main body of the electrolyte. Thus, the ions formed by the cell reaction in the interior portions of the electrode cannont readily escape from the reaction zone of the electrode and cell performance drops. This build-up of ions in the reaction zone and the resultant decrease in cell performance is known as "concentration polarization."

There have been many attempts to provide a gas electrode which permits good gas-electrolyte-electrode contact without drowning or polarizing the electrode. It has been proposed to make pores of the electrode smaller on the electrolyte side of the electrode body than those on the gas side of the body so that the combined effect of the surface tension of the liquid electrolyte in the small pores and the pressure of the gas from the opposite side of the electrode prevents the electrolyte from flooding that portion of the electrode having the larger pores. This requires precise gas pressure control which increases the size and weight of the cell. Furthermore, it is difficult to obtain an electrode having a uniform gradient of pore size ranging from large on the gas side to small on the electrolyte side.

Other methods of improving cell performance have included attempts to wet-proof the electrode such as by dipping the electrode in dilute solutions of wax in a low-boiling solvent. By this method, the electrode is rendered somewhat hydrophobic but the wax can block the electrode pores and/or insulate the electrode surface from the desired reaction.

While electrodes for use in fuel cells have not found commercial utility in chlor-alkali electrolysis, their development is pertinent to the search to obtain a viable electrode in a chlor-alkali cell environment. Thus, Reutschi, U.S. Pat. No. 3,062,909, discloses an oxygen electrode comprising a nickel-silver-paladium powder mixture which is sintered to form a porous electrode. Additionally, a metal screen or expanded metal may be incorporated within the sintered mass of metal powder to lend strength to the electrode while not inhibiting the passage of gas through the electrode.

Kometani, et al, U.S. Pat. No. 3,329,530, describes a sintered fuel cell electrode comprising 50 to 95% by volume of a conductive material such as carbon or nickel and from 5 to 50% by volume of a hydrophobic binder component such as polytetrafluoroethylene (PTFE). The electrode is formed by pressing a powder mixture of the components in a mold and then sintering the resultant article at a temperature substantially higher than the melting point of the binder component. No pressure is utilized during the sintering step, however.

LeDuc, U.S. Pat. No. 3,400,019, describes an electrode having a non-metallic substrate such as a polymer material, ceramic material or graphite, having thereon a film of electroconductive metal which is preferably applied by electroplating.

Carson, et al, U.S. Pat. No. 3,415,689, describes an oxygen electrode wherein a spinel catalyst and PTFE mixture is applied to a porous graphite electrode substrate. Preferred spinel catalysts are cobalt aluminate, magnesium aluminate, silver ferroso-ferric oxide and nickle ferrate. The spinel mixture is applied by a painting process on the graphite substrate.

Darland et al, U.S. Pat. No. 3,423,247, describes an electrode having a microporous high surface area catalyzed layer on the electrolyte side of the electrode and a low surface area non-catalyzed, highly hydrophobic area on the gas side of the electrode. With this structure, gas is able to penetrate the macroporous gas side of the electrode while electrolyte is not able to penetrate this area from the opposite side. This condition creates a reaction zone in the central portion of the electrode and avoids flooding and the consequent failure of the electrode.

In Giner, U.S. Pat. No. 3,438,815, an oxygen electrode is produced by applying a coating of nobel metal black and PTFE in an aqueous solution which is dried and sintered onto a porous metal substrate, the metal being selected from nickel, copper, valve metals, or noble metals. The metal substrate layer may be produced by sintering a mixture of metal powder and ceramic carrier to produce the porous structure.

Deibert, U.S. Pat. No. 3,457,113, describes a laminar electrode having a hydrophobic layer of carbon and polymer laminated with a hydrophilic layer of metal catalyst and electroconductive material. Optionally, a metal screen may be pressed into the laminate in order to strengthen the resultant electrode. The laminate layers are produced by fusion of the binder component with heat and/or pressure.

U.S. Pat. No. 3,600,230, Stachurski, describes a gas-depolarized electrode comprising a metallic grid or screen upon which a layer of hydrophobic resinous material and fiberous conductive material has been formed to create a surface upon which a second layer of catalytically active material such as platinum or silver is formed using a hydrophobic resinous material as a binder.

In Binder, U.S. Pat. No. 3,854,994, a gas electrode is produced by filtering a slurry of polytetraflurorethylene powder to obtain a filter cake followed by the step of drawing a solution of carbon powder, graphite fibers and polytetrafluoroethylene through such filter cake to form a second layer on the filter cake first layer. The electrode is then dried and heated to about 330° C. in a non-oxidizing atmosphere. The filter cake is formed on a metal screen of electroconductive, corrosion resistant material.

Gritzner, U.S. Pat. No. 3,923,628, describes a chlor-alkali cell having an oxygen cathode comprising a silver plated copper screen substrate coated with a mixture of platinum black, silver balck or carbon black with PTFE or other fluorinated hydrophobic polymer. Platinum screening may be substituted for copper screening as substrate material. The high cost of these materials has prevented commercial application of this chlor-alkali cell even though a 200 to 800 millivolt advantage (depending on current density) is indicated by the patent.

None of the above electrodes has found commercial utility in the production of chlorine and caustic in an electrolytic cell. The principal limiting factors have been cost of the electrode material, particularly those employing large amounts of precious metals, and electrode life span in the highly corrosive environment of the cathode compartment of a chlor-alkali electrolytic cell.

It is therefore a principal object of this invention to provide a gas-depolarized electrode for use as a cathode in a chlorine and caustic cell which has sufficient porosity and hydrophobicity for efficient oxygen reduction while having a structural integrity which permits extended life in the corrosive environment of a chlor-alkali cell.

It is another object of this invention to reduce the cost of a gas-depolarized cathode for use in a chlorine and caustic cell through the utilization of common electrocatalytic materials employing only small amounts of precious metals.

These and other objects of the invention are accomplished by a novel electrode and process of making same to be described hereinafter.

SUMMARY OF THE INVENTION

In accordance with the invention, a gas depolarized electrode is comprised of a substrate made from a sintered composite of a prefused mixture of carbon and polytetrafluoroethylene and an electrocatalyst deposited thereon, the substrate providing sufficient porosity so that the potential of the reduction reaction of oxygen at the electrode-electrolyte-gas interface is lower than the hydrogen discharge potential at the surface of steel cathodes as now used in alkali-halide electrolysis.

Further in accordance with the invention, a prefused mixture of carbon and polytetrafluoroethylene is utilized to obtain a cathode substrate for use in chlor-alkali processes by sintering the mixture under high pressure and at a temperature in excess of the sintering temperature of the polymer but below its temperature of decomposition.

In accordance with a more limited aspect of the invention, the previously-described prefused, sintered composite electrode substrate incorporates a foraminous metal backbone structure which lends additional structural integrity to the resultant electrode while acting as an efficient current distributor throughout the electrode.

Further in accordance with the invention, the hydrophobic character of the electrode is augmented by the incorporation of a layer of hydrophobic material applied to one side of the substrate.

Further in accordance with the invention, the hydrophobic character of the electrode is increased by employing a prefused mixture of carbon black and PTFE in which there is a large proportion of PTFE in the mix.

Still further in accordance with the invention, a gas-depolarized electrode for use in chlor-alkali processes is made by a method comprising the steps of mixing a prefused composite of carbon black and polytetrafluoroethylene, forming same into an electrode and sintering the electrode under high pressure and at a temperature in excess of the sintering temperature of the polytetrafluoroethylene and below the decomposition temperature thereof to obtain an electrode substrate and followed by the step of depositing an electrocatalyst on the substrate.

Further in accordance with the invention, the electrode is utilized in an electrolytic cell for the production of halogen and alkali metal hydroxide, the cell comprising an anode compartment, a cathode compartment and a seperator therebetween, the anode compartment having an anode therewithin and aqueous alkali metal halide electrolyte. The cathode compartment comprises a seperator and an oxygen cathode of the type described parallel thereto with electrolyte between the cathode and the seperator and a gas chamber on the opposite side of the cathode and gas feed means for feeding air or oxygen to the gas compartment. With the application of direct current to the anode and cathode, halogen is evolved at the anode and oxygen is reduced in accordance with the foregoing reaction (2) to produce alkali metal hydroxide in the catholyte. The above-described oxygen cathode comprises a substrate of a sintered composite of prefused mixture of polytetrafluoroethylene and carbon black which may optionally include a reinforcing and current distributing material such as wire mesh, the cathode substrate then being coated with an electrocatalyst. The cathode may also have a hydrophobic backing applied to one side thereof.

DETAILED DESCRIPTION OF PREFERRED EMBODIMENTS

The invention will now be described in the more limited aspects of a preferred embodiment thereof. Variations and deviations from the disclosed electrode and process of making same will be apparent to those skilled in the art. It is intended that all such embodiments be included within the scope of the appended claims and that the disclosure of preferred embodiments shall in no way limit the scope of the invention as defined thereby.

In accordance with the invention, a prefused granular mixture of polytetrafluoroethylene and carbon black preferably having a particle size of about 10 microns and having a composition of about 10 to about 70% polytetrafluoroethylene and about 90 to about 30% carbon black is formed into an electrode shape, preferably rectangular, in a sinter press mold. The mold is then compressed at a pressure of 200 to 4,000 psig and heated to a temperature of about 650° to 700° F. This temperature and pressure is then maintained for a period of 5 minutes to 1 hour to effect the sintering and fusion of the polytetrafluoroethylene. The electrode substrate formed has the desired degree of porosity for use as a gas-depolarized electrode for a chlor-alkali cell. The electrode substrate may then be coated with an electrocatalyst as desired.

The principal advantage of the aforedescribed method is that through the utilization of a prefused mixture of PTFE and carbon black, the resultant electrode has a high degree of hydrophobicity compared to a normal, non-prefused mixture while not impairing the gas penetration or occluding the active reaction sites within the porous structure.

Another advantage of the method is that the fabrication of the electrode takes place in one step, that is hot pressing, rather than several steps as with spraying or painting numerous coats of dispersions of polytetrafluoroethylene and carbon black onto a substrate. With such prior spray techniques, numerous cycles of spraying and hot pressing have been necessary to form successive thin coats of material. Careful control of this prior coating process was necessary in that if too thick a coat was formed, mud cracking of the material resulted. With the use of the method of this invention, only one layer of solid is used to produce the finished electrode.

The composition of carbon black and polytetrafluoroethylene used in obtaining the electrodes of the invention is available in various percentage mixtures from Liquid Nitrogen Processing Corporation, Malvern, Pensylvania, as a prefused composite prepared by a proprietary process as a filler for the plastics industry. In applying the composite to use in the present invention, it is necessary to select the appropriate ratio of components for the desired porosity and hydrophobic character of the resultant electrode and sinter press same into a useful product. As is well understood in the art of gas electrodes for fuel cells, the porosity of a polytetrafluoroethylene/carbon electrode is directly related to the carbon loading while hydrophobicity varies directly with the PTFE loading.

The process of sintering the electrode is outlined above stating various parameters for temperature, pressure and time of treatment. Since the process of sintering involves a time-temperature-pressure relationship, however, high temperatures for shorter periods of time can be utilized as well as lower temperatures for a longer period of time. Furthermore, higher or lower pressures may dictate the use of lower or higher temperatures and/or shorter or longer times, respectively. Limitations on the sintering process should not, therefore, be assumed to encompass only those values stated in this description of preferred embodiments but should be understood to encompass any combination which will achieve the desired sintering of the polymer.

In another embodiment of the invention, the composite may be pressed into or onto a support structure such as a polymer fabric or metallic mesh or combinations thereof. Thus, metal screening of iron, steel, nickel, silver, gold, platinum group metals, and valve metals may be utilized. Further, a porous hydrophobic polymer substrate materials such as polyethylene, polypropylene, nylon, TEFLON, or other corrosion-resistant polymers may be employed. When such a reinforcing material is employed, the electrode may be formed by placing the backing material in the mold and adding the prefused composite polytetrafluoroethylene and carbon black to the mold and sintering same under normal procedures for making the electrode in accordance with the invention. Optionally, the polytetrafluoroethylene/carbon black electrode may be preformed and then laminated onto the reinforcing backing.

Electrocatalysts used in the invention may include noble metals, blacks, and mixtures or alloys of these as well as other common catalysts such as silver, gold, non-precious metal oxides and phthalocyahines as well as mixtures thereof. The catalysts may be applied by any of various methods such as painting, spraying, dipping, electroplating or other process common in the art and readily apparent to those skilled in the art of electrocatalysts and electrodes. Also, a pore forming material such as alkaline or pseudo-alkaline carbonates and bicarbonates or the like may be desired or required in the catalyzed layer.

For a fuller understanding of the principles of this invention, there are described hereinafter examples illustrating preferred embodiments of the invention only and not limiting the scope and extent of the invention.

EXAMPLE 1

A prefused mixture of 50% carbon black and 50% PTFE was placed in a 1.5 inch square ram press mold. The material was then heated to 680° F. under a pressure of 200 psig and the temperature and pressure were maintained for 30 minutes to sinter the PTFE. Upon cooling and removal from the mold, the electrode substrate was coated with 0.13 grams of chloroplatinic acid (CPA) applied by spray coating. The electrode was then heated to 400° F. to reduce the CPA to platinum. The electrode was then treated in a sodium borohydride/sodium hydroxide solution for 2 hours to complete the reduction of the platinum. The electrode was then washed with deionized water and placed in a laboratory test cell. The test cell simulates the catholyte side of a membrane-type chlor-alkali cell having a catholyte which is approximately 10 molar sodium hydroxide. A dimensionally stable anode is used along with the cathode which forms one wall of the cell and has an oxygen chamber located on the opposite side of the cathode from the electrolyte. The cathode made as above-described was tested at 1 ampere per square inch (asi) and the potential of the cathodic reaction as compared with a mercury/mercuric oxide electrode ranged from about −0.050 to −0.060 volts. This compares favorably with the cathode potential for mild steel which is about −1.100 volts, compared with the same reference electrode, the oxygen electrode offering about a 1.050 volt advantage over that of a mild steel cathode at that current density.

EXAMPLE 2

A prefused mixture of 50% carbon black and 50% PTFE was cold pressed at approximately 3000 psig. The resultant material was then cut into approximately a 1.5 inch square piece and hot pressed onto a nitric acid etched nickel mesh. The hot press conditions were a pressure of 2000 psig at a temperature of 660° F. for 2 minutes followed by 500 psig pressure for 3 minutes at the same temperature. The initial pressure was to force material through and around the mesh. The lower pressure and 660° F. temperature was then used to sinter the binder. The resultant electrode appeared to have good adhesion. The coupon was then treated with chloroplatinic acid as above with a loading of 1 milligram per square centimeter of platinum resulting. The coupon was then operated in the above-described cell and its potential at 2.0 asi was measured at about −0.190 to 0.200 volts versus the mercury-mercuric oxide reference electrode.

EXAMPLE 3

An electrode produced in the manner of Example 2 was operated at 1 asi in an attempt to determine the lifetime of the electrode. The electrode was operated for approximately 100 days in a test cell as previously described with the potential ranging from −0.080 to −0.100 volts versus the reference electrode. The electrode had not failed by either concentration polarization due to flooding or structural degradation at the time the test was terminated.

EXAMPLE 4

A 30% PTFE and 70% carbon black prefused mixture was applied to a sheet of TEFLON backing material and a nickel mesh material was layed on top of the deposited PTFE-carbon black layer. The laminate was heated to 350° C. at 2000 psig to sinter the PTFE and press the nickel mesh into the composite layer. Upon removal from the press the surface of the laminate was treated with chloroplatinic acid as previously described with a loading of 0.25 to 0.3 milligrams per square centimeter of electrode surface. Reduction of the CPA as above-described was then carried out and the resultant electrode was mounted in the laboratory test cell as above-described under the conditions of the previous Examples. The voltage was measured at 0.5 asi versus the mercury-mercuric oxide electrode at −0.138 volts.

This process would lend itself favorably to continuous roll forming of the electrode whereby the TEFLON fabric would proceed in one direction toward a first station where the prefused mixture of PTFE and carbon black would be applied to the surface thereof, such as by spraying or painting whereupon the material would proceed to a second station where nickel mesh was laid from a roll onto the surface of the PTFE carbon black mixture followed by hot roll pressing of the laminate to sinter the PTFE and produce the desired electrode substrate.

The invention has been described in the more limited aspects of a preferred embodiment and illustrated in specific examples showing the utility of the invention. It is not intended that any such disclosure be construed as a limitation upon the invention but that the scope of such invention shall be interpreted only by the scope of the appended claims.

Having thus described our invention, we claim:

1. A method of forming a porous gas electrode comprising the steps of:

forming a composite of prefused polytetrafluoroethylene and carbon black, wherein said composite contains about 10 to 70 percent polytetrafluoroethylene and about 90 to 30 percent carbon black;

compressing said composite at a pressure ranging from about 100 to about 4,000 psig while heating at least to a temperature above the sinter temperature of said polytetrafluoroethylene and below the decomposition temperature thereof;

maintaining said temperature and pressure for a period of 5 to 60 minutes to form an electrode substrate;

and applying an electrocatalyst to said substrate.

2. The method as described in claim 1 wherein said step of applying an electrocatalyst comprises the steps of:

applying a solution of chloroplatinic acid to said substrate;

initially reducing said chloroplatinic acid to platinum by heating said electrode substrate; and completing said reduction by contacting said electrode substrate with a reducing solution.

3. A method as in claim 2 wherein said heating is conducted at a temperature of about 400° F.

4. A method as in claim 2 wherein said reducing solution contains sodium borohydride and sodium hydroxide.

* * * * *